United States Patent [19]

Baker et al.

[11] Patent Number: 4,547,090

[45] Date of Patent: Oct. 15, 1985

[54] WRITING INSTRUMENT WITH NIB OPERATED VALVE

[75] Inventors: Hugh W. B. Baker, Beaconsfield; Valerie A. Buckle, Slough; Ivor J. M. Fehr, Old Basing, all of England

[73] Assignee: The Gillette Company, Boston, Mass.

[21] Appl. No.: 475,431

[22] Filed: Mar. 15, 1983

[51] Int. Cl.[4] ..... B43K 5/18; B43K 8/02

[52] U.S. Cl. ..... 401/235; 401/206; 401/236; 401/264

[58] Field of Search ..... 401/231, 232, 235, 236, 401/206, 264

[56] References Cited

U.S. PATENT DOCUMENTS

| | | | |
|---|---|---|---|
| 221,815 | 11/1879 | Henkmann | 401/235 |
| 271,455 | 1/1883 | Higgins | 401/235 |
| 274,679 | 3/1883 | Walke | 401/235 |
| 1,938,314 | 12/1933 | Bromer | 401/235 |
| 3,187,724 | 6/1965 | Zepell | 401/235 |

*Primary Examiner*—Steven A. Bratlie

*Attorney, Agent, or Firm*—Leonard J. Janowski

[57] ABSTRACT

A reservoir pen in which flow of ink from a reservoir to a nib is controlled by a valve which is actuated by the deflection of the nib during use.

11 Claims, 4 Drawing Figures

WRITING INSTRUMENT WITH NIB OPERATED VALVE

BACKGROUND OF THE INVENTION

1. Field of the Invention

This invention concerns writing instruments and more especially reservoir pens of the kind in which ink is supplied from the reservoir chamber to the underside of a nib via a capillary channel.

2. Description of the Prior Art

A difficulty often experienced with some pens of the above kind is in dimensioning the ink feed channel to regulate the ink flow so that ink is supplied to the nib at a rate which is both enough to enable the nib to lay down a continuous line of constant width in use of the pen, and low enough to prevent ink dripping from the nib when the pen is not being used and is held with the nib pointing downwards.

To avoid problems of flooding under adverse environmental changes, it is common to provide an overflow chamber, often in the form of grooves in a feed bar which is adjacent to the nib. Excess ink from the reservoir may collect in the overflow chamber and in this way unwanted expulsion of ink from the pen is usually averted. However, the need to provide the overflow chamber inevitably complicates the pen construction and thereby increases manufacturing costs.

SUMMARY OF THE INVENTION

According to the present invention, there is provided a pen comprising a barrel enclosing an ink reservoir, a nib, a feed bar underlying the nib and defining an ink feed channel for supplying ink from the reservoir to the underside of the nib, and valve means controlling the ink feed and actuated by the nib, being arranged to deflect away from the pen axis and relative to the feed bar under normal writing pressure to control the ink flow to the nib.

With the pen according to the invention, the ink supply channel is restricted or preferably closed off when the pen is not actually writing, yet full ink flow is possible when normal writing pressure is exerted on the nib.

The invention is applicable to virtually all reservoir pens including cartridge reservoir pens, collapsible sac reservoir pens, pressurized reservoir pens and refillable reservoir pens. However, the invention may be of particular advantage when embodied in a pen of such a construction that the feed bar is not required to allow passage of air to replace the volume of the ink as it is used up. The feed bar may then be of extremely simple design. Air can be supplied to the reservoir by means of a passage opening at the end of the barrel opposite the nib and including a selective filter, i.e. a filter which is permeable to air but impermeable to liquids.

In a preferred embodiment, the ink feed channel is a bore passing through the feed bar and having an outlet at the underside of the nib, and the valve means is located at the outlet of the ink channel and consists of a seat surrounding the outlet and a valve member positioned between the nib and the seat.

According to one specific construction, the nib is attached to a pen body portion by an integral hinge which biases the nib towards the feed bar to close the valve. In an alternative construction, the nib is inserted into a socket defined between the feed bar and a pen body portion and is pressed towards the feed bar by a resilient foam element interposed between the body portion and the nib. The nib may be a conventional slit metal nib or it may comprise a fiber tip. Other types of nib may also be possible.

BRIEF DESCRIPTION OF THE DRAWING

A better understanding of the invention will be had from the following detailed description which is given with reference to the accompanying drawings in which.

DESCRIPTION OF THE PREFERRED EMBODIMENT

Figure 1:
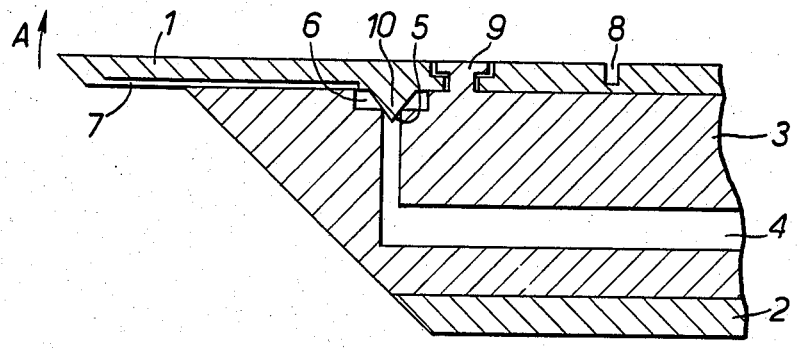
FIG. 1 shows in axial cross-section the writing end of a pen embodying the invention.

The pen shown in FIG. 1 comprises a nib 1 formed integrally with a body portion 2 surrounding a feed bar 3 which underlies the nib. The body portion 2 may be integral with or adapted for connection, e.g. by means of a screw thread, to a pen barrel enclosing an ink reservoir. The reservoir chamber communicates with an ink feed passage 4 provided by a bore in the feed bar 3 having a longitudinal part and a transverse part leading from the longitudinal part to a sharp-edged outlet port 5 located beneath the nib within a circular recess or counterbore 6 in the feed bar. A groove 7 in the undersurface of the nib provides a channel for conducting ink from the recess 6 to the writing tip of the nib.

The nib is connected to the body portion by an integral hinge defined by a slot 8, which enables the nib to flex resiliently from the normal rest position shown in the drawing in the direction indicated by an arrow A. The deflection of the nib is limited by a stop in the form of a headed pin 9 fixed to the feed bar and passing through an opening in the nib which is recessed to receive the pin head. The stop pin can be fixed to the feed bar by welding after insertion of the feed bar in the body portion.

A conical projection 10 is formed on the undersurface of the nib and is aligned with the port 5. The projection 10 constitutes a valve member which in the normal position of the nib is biased into sealing engagement with the sharp edge surrounding the port 5 to close off the ink feed passage interconnecting the reservoir chamber with the nib.

In use of the pen, the normal writing pressure applied to the nib causes it to deflect against the resilience of the hinge, the maximum deflection being limited by the stop 9, and valve member 10 disengages the port 5 to allow ink to flow to the nib.

As the ink passage is shut off when the pen is not writing, there is no risk of drops collecting on and dripping from the nib. Furthermore, the passage in the feed bar may be made larger to reduce the chances of it becoming blocked.

The nib and body portion are preferably made of relatively soft plastics material, such as acetyl copolymer, to ensure good writing characteristics as well as providing the necessary resilience at the hinge and an adequate seal at the valve. The feed bar, which can be made in two parts and then fixed together, is preferably molded from hard plastics material, such as an acrylic, to provide a rigid sharp-edge opening at the port 5. To assist assembly, the feed bar may be keyed in some way to the body portion so that correct radial alignment is ensured between the valve member and seat. Furthermore, the body portion may include an internal shoulder against which the inner end of the feed bar abuts to ensure correct axial location of the feed bar.

For added security against leakage due to shocks, a cap for the pen can be arranged to hold the nib in the position illustrated in the drawing so that the valve is held firmly closed.

As an alternative to the resilient hinge, a spring, e.g. a rubber washer, may be inserted between the pin head 9 and the nib.

Figure 2:
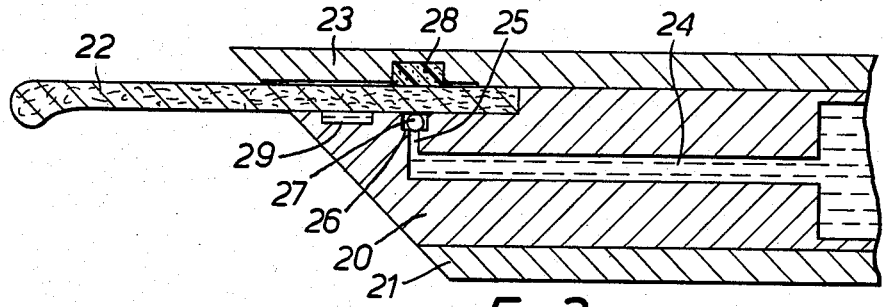
FIG. 2 is a similar view of another pen in accordance with the invention.
Figure 4:
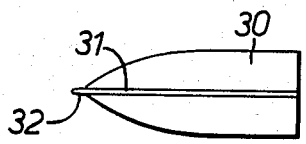
FIG. 4 illustrates a nib of alternative form for the pens of FIGS. 2 and 3.

The pen illustrated in FIG. 2 has a feed bar 20 fixed in a pen body 21, and a nib 22 received partially in a socket defined between the feed bar and an end portion 23 of the body. The feed bar includes an ink feed channel provided by a bore with a longitudinal section 24 and a transverse section 25 which leads to an outlet port. A counterbore at the outlet defines a valve seat 26 and a cylindrical recess in which a ball valve member 27 is accommodated. A pad 28 of resilient foam material is received in a recess formed in the body portion 23 opposite the outlet of the ink feed channel. This pad grips the nib to retain it in the socket and acts on the nib to press it lightly towards the feed bar. The nib in turn presses the ball 27 into sealing contact with the valve seat to close off the ink flow to the nib. Under normal writing pressure, the writing tip of the nib deflects away from the pen axis, i.e. upwardly as seen in the drawing, the nib pivoting about its inner end and against the bias of the pad 28 so that the ball 27 is released and disengages the seat 26 to allow ink to pass to the underside of the nib. The nib deflection is limited by the body portion 23. The nib may be a slit metal nib so that the ink is conducted to the writing tip by capillary action. An alternative form of nib is shown in FIG. 4 and is described below. If desired, to assist in ensuring an uninterrupted flow of ink to the writing tip in use of the pen, an auxiliary reservoir chamber 29 may be provided downstream of the valve by a recess in the feed bar.

Figure 3:
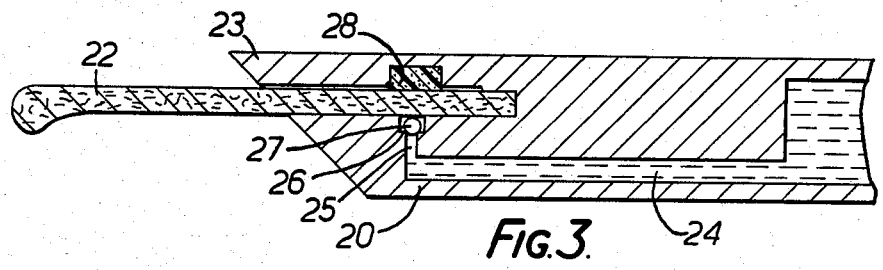
FIG. 3 shows a modification to the pen of FIG. 2.

The modified pen shown in FIG. 3 has the feed bar and body formed integrally. Otherwise it is the same as the pen of FIG. 2 and its construction and operation will be understood from the foregoing description.

The nib shown in plan view in FIG. 4 may be used in the pens of FIGS. 2 and 3 and consists of a flat plastics blade 30 with a fiber or capillary core 31 which extends the length of the blade and projects at the forward end to define a fiber writing tip 32. Ink enters the core 31 from the pen valve and is conducted therealong to the tip 32.

Having thus described our invention, what we claim as new and desire to secure by Letters Patent of the United States is:

1. A reservoir pen comprising a barrel enclosing an ink reservoir, said barrel being unitary with a nib and connecting resilient hinge, a feed bar underlying the nib and defining an ink feed channel for supplying ink from the reservoir to the underside of the nib, and valve means for controlling the ink feed and actuated by the nib, the nib being arranged to deflect against the resilience of the hinge under normal writing pressure to control ink flow to the nib.

2. A reservoir pen according to claim 1, wherein the ink feed channel comprises a bore through the feed bar and has an outlet directed towards the underside of the nib.

3. A reservoir pen according to claim 2, wherein the valve means is located at the outlet of the ink feed channel.

4. A reservoir pen according to claim 3, wherein the valve means comprises a valve seat surrounding said outlet and a valve member positioned between the nib and the seat.

5. A reservoir pen according to claim 4, wherein the outlet of the ink feed channel is defined by a bore transverse to the pen axis, the seat is formed by a counterbore, and the valve member is accommodated in the counterbore.

6. A reservoir pen according to claim 4 wherein the valve member is attached to the nib.

7. A reservoir pen comprising a barrel enclosing an ink reservoir, a nib, a body portion, a resilient element interposed between the nib and the body portion, a feed bar underlying the nib and defining an ink feed channel for supplying ink from the reservoir to the underside of the nib, and valve means for controlling the ink feed and actuated by the nib, said resilient element being on the opposite side of the nib from the valve means with the nib therebetween and being adapted to press said nib lightly towards said feed bar.

8. A reservoir pen according to claim 7, wherein the nib is partly received between the feed bar and the pen body portion.

9. A reservoir pen according to claim 8, wherein the resilient element comprises a pad of compressible material.

10. A reservoir pen according to claim 8 wherein the nib deflects under writing pressure, the deflection being limited by abutment with the body portion.

11. A reservoir pen according to claim 7 wherein the nib comprises a flat plastic blade having a fiber or capillary core which projects at the forward end to define a writing tip.

* * * * *